US011692553B2

(12) United States Patent
Haaf et al.

(10) Patent No.: US 11,692,553 B2
(45) Date of Patent: Jul. 4, 2023

(54) DIAGONAL FAN HAVING SWIRL REDUCTION AT THE DIAGONAL IMPELLER

(71) Applicant: ebm-papst Mulfingen GmbH & Co. KG, Mulfingen (DE)

(72) Inventors: Oliver Haaf, Kupferzell (DE); Daniel Gebert, Öhringen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 26 days.

(21) Appl. No.: 17/281,688

(22) PCT Filed: Oct. 7, 2019

(86) PCT No.: PCT/EP2019/077103
§ 371 (c)(1),
(2) Date: Mar. 31, 2021

(87) PCT Pub. No.: WO2020/099027
PCT Pub. Date: May 22, 2020

(65) Prior Publication Data

US 2022/0025892 A1 Jan. 27, 2022

(30) Foreign Application Priority Data

Nov. 16, 2018 (DE) ..... 10 2018 128 813.1

(51) Int. Cl.
*F04D 25/06* (2006.01)
*F04D 19/00* (2006.01)

(52) U.S. Cl.
CPC ..... *F04D 19/002* (2013.01); *F04D 25/06* (2013.01)

(58) Field of Classification Search
CPC ..... F04D 19/002; F04D 25/08; F04D 25/12; F04D 29/181–183; F04D 29/326; F04D 29/522; F04D 29/526
See application file for complete search history.

(56) References Cited

U.S. PATENT DOCUMENTS 6,398,492 B1 * 6/2002 Cho ..... F04D 29/544 416/189
2010/0111667 A1 * 5/2010 Stagg ..... F04D 29/281 415/191

(Continued)

FOREIGN PATENT DOCUMENTS

DE 102006049076 A1 4/2008
DE 102010032168 A1 1/2012

(Continued)

OTHER PUBLICATIONS

European Patent Office, Rijswijk, Netherlands, International Search Report of International Application No. PCT/EP2019/077103, dated Dec. 17, 2019, 2 pages.

*Primary Examiner* — Thomas Fink
(74) *Attorney, Agent, or Firm* — Dickinson Wright PLLC

(57) ABSTRACT

A diagonal fan includes an electric motor, a housing, and a diagonal impeller received inside the housing and drivable via the motor. The diagonal flow during operation is deflected in an axial flow direction. The diagonal impeller includes impeller blades distributed in the circumferential direction and a slinger ring encloses said blades. The diagonal fan includes an inlet nozzle on the suction side accommodating a main flow for the diagonal fan. The inlet nozzle extends overlapping at least in sections relative to the radial section of the slinger ring forming a nozzle gap therewith. A bypass channel on the housing forms a flow connection from a pressure-side surrounding region (U) of the diagonal fan to an inflow side of the nozzle gap. During operation of the (Continued)

diagonal fan, a swirl-free secondary flow (NS) is guided at the inflow side of the nozzle gap via the bypass channel.

16 Claims, 1 Drawing Sheet

(56) References Cited

U.S. PATENT DOCUMENTS

| | | | | |
|---|---|---|---|---|
| 2012/0039731 | A1* | 2/2012 | Sadi | F04D 29/164<br>417/423.7 |
| 2018/0142700 | A1 | 5/2018 | Hub et al. | |

FOREIGN PATENT DOCUMENTS

| | | | |
|---|---|---|---|
| DE | 102014210373 | A1 | 12/2015 |
| DE | 202017102950 | U1 | 6/2017 |
| DE | 112016003244 | T5 | 4/2018 |
| DE | 102016122533 | A1 | 5/2018 |
| RU | 2667590 | C1 | 9/2018 |
| WO | 8502889 | A1 | 7/1985 |
| WO | 2008074307 | A1 | 6/2008 |

* cited by examiner

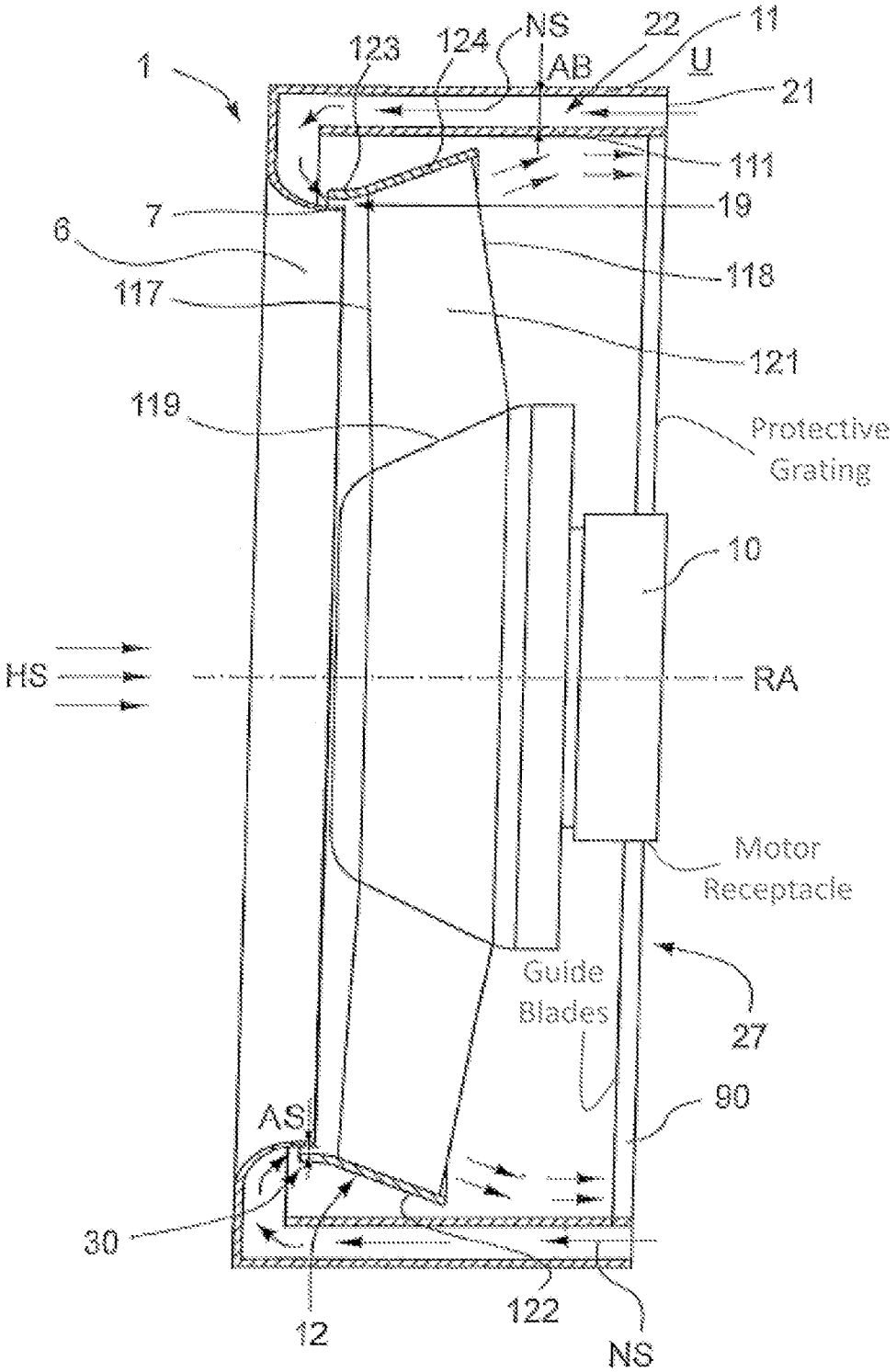
1
123
124
NS
22
11
AB
U
21
111
19
7
6
118
117
121
119
Protective Grating
10
HS
RA
Motor Receptacle
Guide Blades
27
90
AS
30
12
122
NS

DIAGONAL FAN HAVING SWIRL REDUCTION AT THE DIAGONAL IMPELLER

CROSS REFERENCE TO RELATED APPLICATIONS

This application is a 35 U.S.C. § 371 national phase application of International Application No.: PCT/EP2019/077103, filed Oct. 7, 2019, which claims the benefit of priority under 35 U.S.C. § 119 to German Patent Application No.: 10 2018 128 813.1, filed Nov. 16, 2018, the contents of which are incorporated herein by reference in their entirety.

FIELD

The invention relates to a diagonal fan having swirl reduction at the diagonal impeller.

BACKGROUND

The statements in this section merely provide background information related to the present disclosure and several definitions for terms used in the present disclosure and may not constitute prior art.

Diagonal fans and their use are generally known from the prior art, for example from DE 10 2014 210 373 A1.

Diagonal fans are used in applications having high demands for air output with higher counter pressure and small installation space, for example in refrigeration technology or in extractor hoods. Due to the large motor diameter of the axially-centrally arranged motor in relation to the installation space and the radial expansion of the hub in diagonal fans, the discharge area at the discharge opening is comparatively small, whereby high outlet losses occur in the flow due to high dynamic pressure at the outlet of the diagonal fan.

SUMMARY

Axial fans are typically used for achieving high throw distances. However, diagonal fans are favorable for the compact construction. An objective of the present disclosure is to provide a diagonal fan which is improved with respect to efficiency and throw distance and is thus usable in a broader usage range.

This objective is achieved by the combination of features in a diagonal fan that comprises an electric motor, a housing, and a diagonal impeller, which is received inside the housing and is drivable via the electric motor, and the diagonal flow of which generated in operation is deflected in an axial flow direction. The diagonal impeller includes impeller blades distributed in the circumferential direction and a slinger ring, which encloses the impeller blades in the circumferential direction. The diagonal fan furthermore includes an inlet nozzle on the suction side, through which a main flow (HS) of the diagonal fan is suctioned in, wherein the inlet nozzle extends overlapping at least in sections in relation to the slinger ring viewed in radial section and forms a nozzle gap with the slinger ring at the same time. A bypass channel is formed on the housing, which forms a flow connection from a pressure-side surrounding region (U) of the diagonal fan to an inflow side of the nozzle gap, so that in operation of the diagonal fan, a swirl-free secondary flow (NS) is guided at the inflow side of the nozzle gap via the bypass channel.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawing, in which:

FIG. 1 shows a schematic radial section of an exemplary embodiment of a diagonal fan.

The drawing is provided herewith for purely illustrative purposes and is not intended to limit the scope of the present invention.

DETAILED DESCRIPTION

The following description is merely exemplary in nature and is in no way intended to limit the present disclosure or its application or uses. It should be understood that throughout the description, corresponding reference numerals indicate like or corresponding parts and features.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

According to one aspect of the present disclosure, a diagonal fan is proposed having an electric motor, a housing, and a diagonal impeller received inside the housing and drivable via the electric motor. The diagonal flow generated by the diagonal impeller in operation is deflected by the housing in an axial flow direction. The diagonal impeller has impeller blades distributed in the circumferential direction and a slinger ring, which encloses the impeller blades in the circumferential direction. The diagonal fan furthermore comprises an inlet nozzle on the intake side, through which a main flow of the diagonal fan is suctioned in, wherein the inlet nozzle extends overlapping at least in sections in relation to the slinger ring viewed in the radial direction and forms a nozzle gap with the slinger ring in this case. Moreover, a bypass channel is provided on the housing, which forms a flow connection from a surrounding region on the pressure side of the diagonal fan to an inflow side of the nozzle gap, so that a swirl-free secondary flow is guided at the inflow side of the nozzle gap in operation of the diagonal fan via the bypass channel.

The present disclosure solves the problem by way of the inflow of the swirl-free secondary flow into the nozzle gap via the bypass channel. A gap flow is generated in the nozzle gap upon the use of the combination of inlet nozzle and slinger ring, which results in the improved application of the flow to the slinger ring. This gap flow is fed in diagonal fans having channel-type, in particular cylindrical housings in particular from the highly turbulent and swirl-subjected flow at the outlet (pressure side) of the diagonal impeller. The turbulent gap flow causes increased noise formation upon the interaction with the inflow-side blade front edges of the impeller blades. Due to the spin in the gap flow, the inflow vector to the diagonal impeller changes significantly within the shear layer between the gap flow and the main flow, whereby an incorrect incident flow of the impeller blades occurs, i.e., an incident flow at a non-optimum angle. The respective angle difference of the inflow vector is dependent on the operating point and cannot be geometrically compensated for at the impeller wheels. The gap flow is influenced by the supply of the swirl-free secondary flow via the bypass channel into the intake nozzle such that the noise formation is minimized and the efficiency of the diagonal fan is increased.

According to another aspect of the present disclosure, it is provided that the bypass channel extends in parallel to an outer jacket wall of the housing and defines an inner wall of the housing, which deflects the diagonal flow generated by the diagonal impeller into the axial flow direction. The bypass channel is thus installed in a space-saving manner as an integral component of the housing.

An embodiment of the diagonal fan is fluidically advantageous in which the bypass channel has an axial flow cross-sectional area AB, which has a ratio to an axial flow cross-sectional area AS such that $0.5 \leq AB/AS \leq 5$ applies. The ratio is preferably selected such that $0.75 \leq AB/AS \leq 2.5$ applies. In the mentioned ranges, the influence of the swirl-free secondary flow via the bypass channel is particularly effective.

Furthermore, it is provided according to another aspect of the present disclosure that the bypass channel encloses the diagonal impeller on the radial outside and is therefore arranged at an axial height in relation to the diagonal impeller. Instead of one completely enclosing channel, for example, two or four channels can also be arranged in the corners to better utilize the installation space.

The bypass channel may be furthermore embodied in an axial length such that it extends over the diagonal impeller in the axial direction on both sides, i.e., viewed in radial section, it extends beyond axial edge planes of the diagonal impeller on both sides. In particular, it is favorable if the inlet of the bypass channel on the pressure side is connected to the surroundings of the diagonal fan separately from the discharge region of the main flow.

To reduce the number of parts and simplify the assembly, it is preferably provided that the bypass channel is integrally formed on the housing.

Furthermore, it is fluidically advantageous that in the diagonal fan the slinger ring and the inlet nozzle extend in parallel at least in sections in the region of the nozzle gap. In particular, it is preferably provided that the slinger ring extends coaxially radially outside the inlet nozzle, so that the nozzle gap is formed on the radial outside of the inlet nozzle.

In one refinement of the diagonal fan, the slinger ring in the nozzle section extends in parallel to a rotational axis of the diagonal impeller extending in the axial direction of the diagonal fan, i.e., in the overlap section, the slinger ring and the inlet nozzle extend in parallel to the axially suctioned-in flow direction.

To generate an outflow diagonally radially outward and angled in relation to the rotational axis of the diagonal impeller, the slinger ring has a flow cross section widening radially outward in the axial flow direction and oriented toward an inner wall of the housing.

In the diagonal fan according to yet another aspect of the present disclosure, a redirection device having a plurality of guide blades distributed in the circumferential direction is arranged adjacent to the diagonal impeller viewed in the axial flow direction, which evens out an airflow generated by the diagonal impeller.

Another aspect of the present disclosure provides in the diagonal fan that the redirection device is integrally formed with the housing. The number of parts and assembly steps can thus be reduced. A seal between the components can also be omitted.

The redirection device includes a protective grating extending over a discharge section of the diagonal fan in one refinement.

Furthermore, an embodiment variant of the diagonal fan is advantageous in which the redirection device, the housing, and the protective grating are integrally formed.

For variable fastening of the diagonal fan on at least two fastening points, at least two axial screw-on planes each having fastening means for fastening the diagonal fan are formed on the housing. The diagonal fan is preferably fastened on a heat exchanger.

Furthermore, a refinement of the diagonal fan with respect to a compact construction is advantageous in which the redirection device includes a motor receptacle for the electric motor in the hub region. The fastening of the electric motor can thus be taken over by the redirection device.

Other advantageous refinements of the invention are characterized in the claims or are described in greater detail together with the description of one embodiment of the present disclosure provided as an example in FIG. 1.

FIG. 1 shows a schematic radial section of a diagonal fan. The diagonal fan 1 comprises a housing 11, in which the electric motor 10, designed as an external rotor motor, is received and is connected to the diagonal impeller 12, in order to rotate the latter in operation around the rotational axis RA. The diagonal impeller 12 is fastened using its hub 119 on the electric motor 10. Multiple impeller blades 121 distributed in the circumferential direction extend radially outward from the hub 119, the radial outer end of which is closed by the slinger ring 122. The impeller blades 121 have a blade front edge 117 and a blade rear edge 118, which are each inclined in relation to a vertical perpendicular to the rotational axis from radially inward to radially outward viewed on the inlet side of the diagonal fan 1, wherein the angle is greater on the blade rear edge 118 than on the blade front edge 117.

On the suction side, the inlet nozzle 6 integrally formed on the housing 11 is provided, through which the diagonal impeller 12 suctions in the main flow HS in operation. The inlet nozzle 6 has a flow cross section reduced in the axial direction, which is smallest at the axial free end section 7. This free end section 7 extends in parallel to the rotational axis RA and overlaps in the overlap region 30 with the front section 123 of the slinger ring 122, which also extends in parallel to the rotational axis RA. The nozzle gap 19 is formed by the slinger ring 122 and the inlet nozzle 6. The rear section 124, which extends diagonally outward and angled in relation to the rotational axis, directly adjoins the axially-parallel front section 123 at the slinger ring 122, and defines the flow cross section, which widens radially outward in the axial flow direction and is oriented toward an inner wall 111 of the housing 11.

The bypass channel 22 is integrally formed on the housing 11, which extends from the discharge section 27 of the diagonal fan 1 in the axial direction up to the inlet nozzle 6 and forms a flow connection from the pressure-side surrounding region U of the diagonal fan 1 via the axial inlet opening 21 to the inflow side of the nozzle gap 19. In operation, in addition to the main flow, the swirl-free secondary flow NS extending in the opposite direction in the bypass channel 22 is generated and supplied via the nozzle gap 19 to the main flow HS. The bypass channel 22 extends over the entire diagonal impeller 12 in the axial direction and is arranged on the radial outside in relation thereto integrally on the housing 11. The bypass channel 22 has an axial flow cross-sectional area AB which is defined in the ratio to an axial flow cross-sectional area AS of the nozzle gap 19 in the embodiment shown so that AB/AS=3.0. The ratio is preferably set in a range of 0.5-5.0.

Moreover, the diagonal fan 1 comprises a redirection device 90 on the discharge section 27, which subsequently evens out the diagonal flow discharged at an angle by the diagonal impeller 12 and the flow deflected from the inner wall 11 back in the axial direction. The redirection device 90 comprises a plurality of guide blades distributed in the circumferential direction and a protective grating, which extends over the discharge section 27 of the diagonal fan 1.

While the above description constitutes the preferred embodiments of the present invention, it will be appreciated that the invention is susceptible to modification, variation and change without departing from the proper scope and fair meaning of the accompanying claims.

The invention claimed is:

1. A diagonal fan comprising an electric motor, a housing, and a diagonal impeller, which is received inside the housing and is drivable via the electric motor, and the diagonal flow of which generated in operation is deflected in an axial flow direction, wherein the diagonal impeller includes impeller blades distributed in the circumferential direction and a slinger ring, which encloses the impeller blades in the circumferential direction, wherein the diagonal fan furthermore includes an inlet nozzle on the suction side, through which a main flow (HS) of the diagonal fan is suctioned in, wherein the inlet nozzle extends overlapping at least in sections in relation to the slinger ring viewed in radial section and forms a nozzle gap with the slinger ring at the same time, wherein a bypass channel is formed on the housing, which forms a flow connection from a pressure-side surrounding region (U) of the diagonal fan to an inflow side of the nozzle gap, so that in operation of the diagonal fan, a swirl-free secondary flow (NS) is guided at the inflow side of the nozzle gap via the bypass channel, wherein an inner wall of the housing deflects the diagonal flow generated by the diagonal impeller into the axial flow direction, wherein the diagonal fan furthermore includes a redirection device located such that the flow connection formed between the bypass channel and the pressure-side surrounding region (U) is downstream of the redirection device.

2. The diagonal fan as claimed in claim 1, wherein the bypass channel extends in parallel to an outer jacket wall of the housing and defines the inner wall of the housing that deflects the diagonal flow generated by the diagonal impeller in the axial flow direction.

3. The diagonal fan as claimed in claim 1, wherein the bypass channel has an axial through-flow cross-sectional area AB, which has a ratio to an axial through-flow cross-sectional area AS of the nozzle gap such that 0.5≤AB/AS≤5.

4. The diagonal fan as claimed in claim 1, wherein the bypass channel encloses the diagonal impeller on the radial outside at least in regions.

5. The diagonal fan as claimed in claim 1, wherein the bypass channel extends beyond the diagonal impeller on both sides in the axial direction.

6. The diagonal fan as claimed in claim 1, wherein the bypass channel is integrally formed on the housing.

7. The diagonal fan as claimed in claim 1, wherein the slinger ring and the inlet nozzle extend in parallel at least in sections in the region of the nozzle gap.

8. The diagonal fan as claimed in claim 1, wherein the slinger ring extends coaxially radially outside the inlet nozzle.

9. The diagonal fan as claimed in claim 1, wherein the slinger ring extends in the region of the nozzle gap in parallel to a rotational axis of the diagonal impeller extending in the axial direction of the diagonal fan.

10. The diagonal fan as claimed in claim 1, wherein the slinger ring has a flow cross section widening radially outward in the axial flow direction and oriented toward an inner wall of the housing.

11. The diagonal fan as claimed in claim 1, characterized in that the redirection device includes a plurality of guide blades distributed in the circumferential direction, which evens out an airflow generated by the diagonal impeller, is arranged adjoining the diagonal impeller viewed in the axial flow direction.

12. The diagonal fan as claimed in claim 1, characterized in that the redirection device includes a protective grating extending over a discharge section of the diagonal fan.

13. The diagonal fan as claimed in claim 1, characterized in that the redirection device includes a motor receptacle for the electric motor in a hub region.

14. The diagonal fan as claimed in claim 3, wherein the bypass channel has an axial through-flow cross-sectional area AB, which has a ratio to an axial through-flow cross-sectional area AS of the nozzle gap such that 0.75≤AB/AS≤2.5.

15. The diagonal fan as claimed in claim 2, wherein the bypass channel has an axial through-flow cross-sectional area AB, which has a ratio to an axial through-flow cross-sectional area AS of the nozzle gap such that 0.5≤AB/AS≤5.

16. The diagonal fan as claimed in claim 15, wherein the bypass channel has an axial through-flow cross-sectional area AB, which has a ratio to an axial through-flow cross-sectional area AS of the nozzle gap such that 0.75≤AB/AS≤2.5.

* * * * *